US008520874B1

(12) United States Patent
Beutler

(10) Patent No.: US 8,520,874 B1
(45) Date of Patent: Aug. 27, 2013

(54) HEARING AID WITH AN OPERATIONAL BASED SWITCH

(76) Inventor: Gary Beutler, Rancho Cordova, CA (US)

( * ) Notice: Subject to any disclaimer, the term of this patent is extended or adjusted under 35 U.S.C. 154(b) by 134 days.

(21) Appl. No.: 13/136,174

(22) Filed: Jul. 26, 2011

(51) Int. Cl.
*H04R 25/00* (2006.01)

(52) U.S. Cl.
USPC ..... 381/313; 381/322; 381/323

(58) Field of Classification Search
USPC ..... 381/313, 322–323
See application file for complete search history.

(56) References Cited

U.S. PATENT DOCUMENTS

| | | | | |
|---|---|---|---|---|
| 4,955,729 | A | 9/1990 | Marx | |
| 5,341,433 | A | 8/1994 | Meyer et al. | |
| 7,039,208 | B2 | 5/2006 | Wagner et al. | |
| 7,450,731 | B2 | 11/2008 | Barthel | |
| 7,522,739 | B2 | 4/2009 | Rass et al. | |
| 7,561,708 | B2 | 7/2009 | Rohrlein | |
| 7,881,486 | B1 * | 2/2011 | Killion et al. | 381/313 |
| 2007/0098195 | A1 | 5/2007 | Holmes | |
| 2008/0232622 | A1 * | 9/2008 | Higgins et al. | 381/323 |
| 2009/0052710 | A1 * | 2/2009 | Smith | 381/328 |
| 2009/0129618 | A1 | 5/2009 | Heerlein et al. | |
| 2010/0119100 | A1 | 5/2010 | Devine | |

* cited by examiner

*Primary Examiner* — Brian Ensey
*Assistant Examiner* — Katherine Faley
(74) *Attorney, Agent, or Firm* — Thomas R. Lampe

(57) ABSTRACT

A hearing aid device includes ear engagement structure, including a speaker, which actuates the hearing device when pressed against the ear of a user. Withdrawing the ear engagement structure from the ear deactuates the hearing aid device.

7 Claims, 1 Drawing Sheet

HEARING AID WITH AN OPERATIONAL BASED SWITCH

TECHNICAL FIELD

This invention relates to a hearing aid device, more particularly, a hand-held hearing aid device that is actuated by being pushed into engagement with an outer surface of an ear and deactuated when pulled away from the ear.

BACKGROUND OF THE INVENTION

Hearing aid devices are in widespread usage and are of many different types. Some hearing aid devices have structure external of the ear while others are substantially wholly positioned within the auditory canal of the ear.

Many such arrangements are complex and expensive. Some of these devices incorporate push buttons or employ switching arrangements that sense certain conditions, such as temperature, moisture, etc., to turn on a hearing aid when in use and turn off the hearing aid when not of use. While most hearing aid devices incorporate controls that must be operated by hand, proximity sensors, remote controls, and magnets that must be worn have been employed to control operation of installed hearing aids.

The following patent documents are believed to be exemplary of the current state of the prior art in this field: U.S. Pat. No. 7,450,731, issued Nov. 11, 2008, U.S. Pat. No. 7,561,708, issued Jul. 14, 2009, U.S. Pat. No. 7,522,739, issued Apr. 21, 2009, U.S. Pat. No. 7,039,208, issued May 2, 2006, U.S. Pat. No. 5,341,433, issued Aug. 23, 1994, U.S. Pat. No. 4,955,729, issued Sep. 11, 1990, U.S. Patent App. Pub. US 2010/0119100, published May 13, 2010, U.S. Patent App. Pub. US 2009/0129618, published May 21, 2009, and U.S. Patent App. Pub. US 2007/0098195, published May 3, 2007.

In addition to the complexity and relatively high expense of existing hearing aides, such devices have other drawbacks. Since most such arrangements remain on, background noise, and even the wearer's own voice, can cause acoustic interference interfering with the normal function of the hearing aid. Feedback in the electrical circuitry of the device can occur. Also, hearing aid devices that remain on for a continuous length of time deplete battery charge much faster than if the device is turned on or off intermittently when utilized. For example, if a user can readily deactuate the hearing aid device when he or she is talking and readily actuate the device only when choosing to listen, the battery life will be significantly extended.

This is possible with the present invention.

DISCLOSURE OF INVENTION

The present invention relates to a hearing aid device which can readily be actuated and deactuated by a user, these functions accomplished by pressing the device against an outer surface of the ear to actuate and by pulling the device in a direction away from the ear to deactuate. Deactuation eliminates the possibility of feedback due to sounds picked up by the device, including the sound of the user's voice.

The subject hearing aid device is characterized by its simplicity, relatively low cost and ease of use, as compared to prior art hearing aids.

The hearing aid device includes a manually graspable member and ear engagement structure including a speaker, the ear engagement structure connected to the manually graspable member and movable relative to the manually graspable member between a first position and a second position.

Biasing structure biases the ear engagement structure toward the first position.

A microphone is connected to the manually graspable member.

An amplifier is operatively associated with the microphone and the speaker.

A power source provides electrical power to the amplifier, the microphone and the speaker.

A switch is operatively associated with the ear engagement structure for completing an electrical connection between the speaker and the amplifier when the ear engagement structure moves to the second position from the first position against the bias exerted by the biasing structure and for breaking the electrical connection when the biasing structure returns the ear engagement structure to the first position.

Other features, advantages and objects of the present invention will become apparent with reference to the following description and accompanying drawings.

MODES FOR CARRYING OUT THE INVENTION

Figure 1:
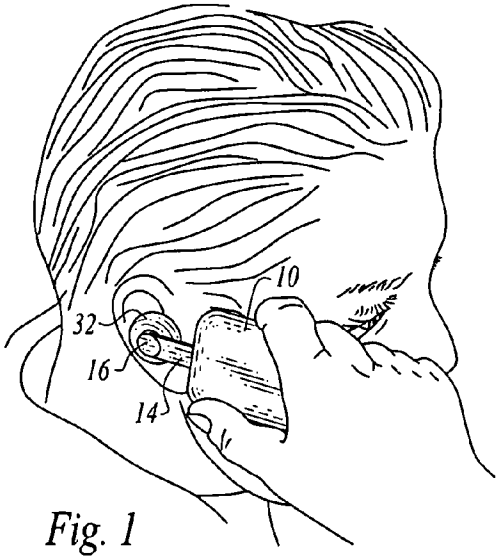
FIG. 1 is a perspective view illustrating a preferred embodiment of the hearing aid device in use by an individual.
Figure 2:
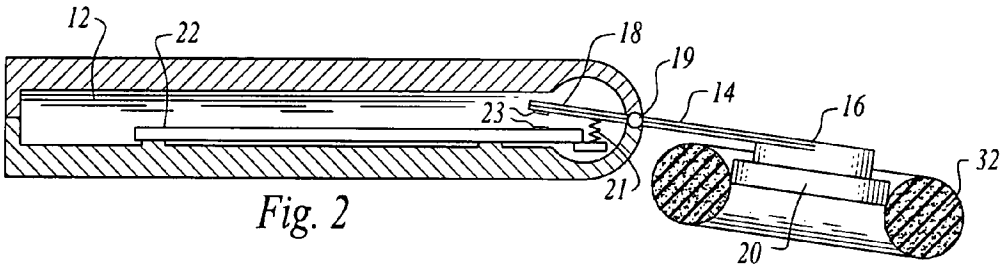
FIG. 2 is a side, elevational view in partial cross-section showing relative positions of components of the device when the device is deactuated.
Figure 3:
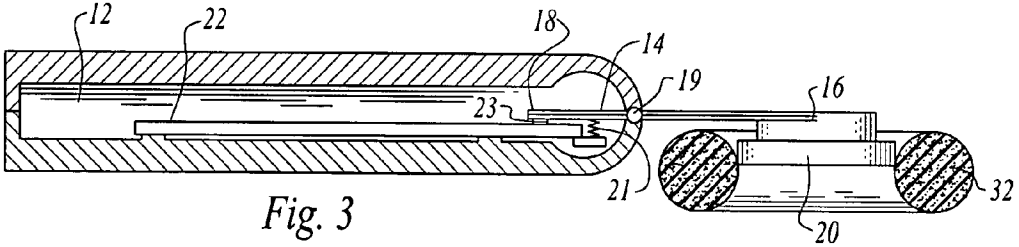
FIG. 3 is a view similar to FIG. 2, but showing the components of the device when the device is actuated.

Referring now to FIGS. 1-4, a hearing aid device constructed in accordance with the teachings of the present invention includes a manually graspable member in the form of a housing 10 defining a housing interior 12. Ear engagement structure extends outwardly from the housing interior. The ear engagement structure includes an arm 14 having an outer end 16 and an inner end 18. The arm is pivotally mounted on the housing at a pivot 19.

A speaker 20 is mounted at the outer end 16 of arm 14. The arm and speaker are pivotally movable between a first position (shown in FIG. 2) and a second position (shown in FIG. 3). Biasing structure in the form of a coil compression spring 21 biases the ear engagement structure toward the first position.

Positioned adjacent to the inner end 18 of arm 14 is a circuit board 22 including a contact switch 23 associated with an amplifier 24. When the ear engagement structure is in the first position shown in FIG. 2, the contact switch 23 is open. When the ear engagement structure is in the second position shown in FIG. 3, the contact switch 22 is closed due to engagement of the inner arm end 18 with the switch.

Figure 4:
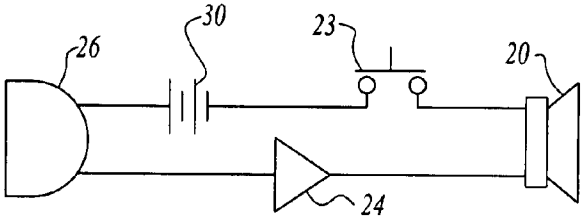
FIG. 4 is a circuit diagram of the device.

As may be seen with reference to FIG. 4, the contact switch is part of an electrical circuit along with the speaker 20 and amplifier 24, the latter incorporated in the circuit board. The circuit board is connected by wiring (not shown) with the speaker and also with a microphone 26. Preferably, the microphone is a directional microphone connected to the housing and oriented in a direction away from the ear engagement structure. A power source in the form of a battery 30 within the housing interior is also in the electrical circuit and provides electrical power to the amplifier, the microphone and the speaker.

The switch 23 completes an electrical connection between the speaker and the amplifier when the ear engagement structure moves to the second position from the first position against the bias exerted by the biasing structure. The switch breaks that electrical connection when the biasing structure returns the ear engagement structure to the first position.

The ear engagement structure additionally includes seal structure in the form of a resilient pad 32 surrounding the speaker. The seal structure is operable to substantially prevent ambient noise from entering an ear of a user of the hearing aid device engaged by the ear engagement structure. Engagement of the pad is with the surface of the ear outside the auditory canal of the ear. The pad surrounds the auditory canal. When the pad is pressed against the ear, the ear engagement structure is moved to the second position and the hearing aid device is actuated. When the user pulls the ear engagement structure away with the ear, the hearing aid device is deactuated.

Figure 5:
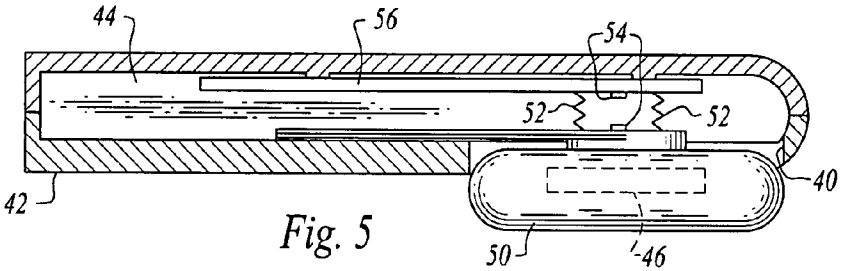
FIG. 5 is a view similar to FIG. 2 showing an alternative embodiment of the device.
Figure 6:
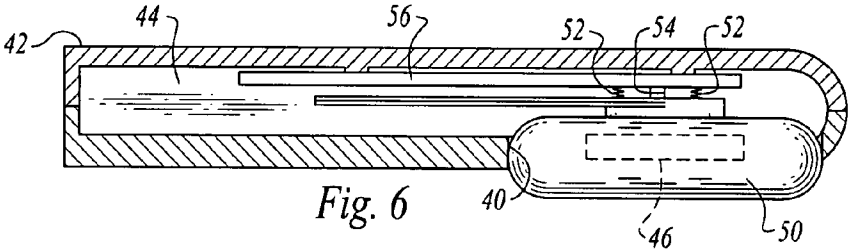
FIG. 6 is a view similar to FIG. 3 showing the alternative embodiment.

FIGS. 5 and 6 illustrate a second embodiment of the apparatus wherein the ear engagement structure is axially movable relative to the housing in an opening 40 formed in housing 42 and communicating with the housing interior 44.

No arm is incorporated in the ear engagement structure shown in FIGS. 5 and 6. The ear engagement structure of the second embodiment includes a speaker 46 slidably movable relative to housing 42. A resilient pad 50 surrounds the speaker. Compression springs 52 bias the speaker and pad in an outward direction. When the pad 50 is pressed into engagement with the ear of a wearer, the speaker slides inwardly and causes a contact switch element 54 connected to the speaker to engage circuit board 56. Other than the structure just described, the embodiment of FIGS. 5 and 6 is essentially the same as that of the first embodiment.

The invention claimed is:

1. A hearing aid device comprising, in combination:

a manually graspable member;

ear engagement structure including a speaker, said ear engagement structure connected to said manually graspable member and movable relative to said manually graspable member between a first position and a second position;

biasing structure biasing said ear engagement structure toward said first position;

a microphone connected to said manually graspable member;

an amplifier operatively associated with said microphone and said speaker;

a power source for providing electrical power to said amplifier, said microphone and said speaker; and a switch operatively associated with said ear engagement structure for completing an electrical connection between said speaker and said amplifier when said ear engagement structure moves to said second position from said first position against the bias exerted by said biasing structure and for breaking said electrical connection when said biasing structure returns said ear engagement structure to said first position, said manually graspable member comprising a housing defining an interior accommodating said amplifier, said power source and said switch.

2. The hearing aid device according to claim 1 wherein said ear engagement structure additionally includes an arm having an inner end and an outer end, said speaker mounted at said outer end, and said arm pivotally connected to said manually graspable member at a location spaced from said speaker, said arm pivoting relative to said manually graspable member when said ear engagement structure moves between said first and second positions.

3. The hearing aid device according to claim 1 wherein said ear engagement structure additionally includes seal structure surrounding said speaker, said seal structure operable to substantially prevent ambient noise from entering an ear of a user of the hearing aid device engaged by said ear engagement structure.

4. The hearing aid device according to claim 3 wherein said seal structure comprises a resilient pad surrounding said speaker.

5. The hearing aid device according to claim 1 wherein said ear engagement structure is axially movable relative to said housing in an opening defined by said housing and communicating with said housing interior.

6. The hearing aid device according to claim 3 wherein said ear engagement structure moves from said first position to said second position responsive to pressing of the seal structure against the ear outside the auditory canal of the ear.

7. The hearing aid device according to claim 1 wherein said microphone is a directional microphone oriented in a direction away from said ear engagement structure.

* * * * *